US008365361B1

(12) United States Patent
Ahern

(10) Patent No.: US 8,365,361 B1
(45) Date of Patent: Feb. 5, 2013

(54) LAUNDRY RETAINER FOR BED SHEETS

(76) Inventor: Marcus W. Ahern, O'Fallon, MO (US)

( * ) Notice: Subject to any disclaimer, the term of this patent is extended or adjusted under 35 U.S.C. 154(b) by 216 days.

(21) Appl. No.: 12/780,090

(22) Filed: May 14, 2010

(51) Int. Cl.
*A47C 21/02* (2006.01)

(52) U.S. Cl. ..... 24/72.5; 24/338

(58) Field of Classification Search ..... 24/72.5, 24/298, 485, 493, DIG. 29, 72.7, 712.1, 302, 24/303, 300, 326, 327, 329, 331, 335, 336, 24/338, 511, 45, 492, 495, 30.5 R; D11/215; 2/323

See application file for complete search history.

(56) References Cited

U.S. PATENT DOCUMENTS

| | | | | | |
|---|---|---|---|---|---|
| 202,735 | A | * | 4/1878 | Lindsay | 24/301 |
| 220,680 | A | * | 10/1879 | Strickrodt | 24/511 |
| 268,089 | A | * | 11/1882 | Freer | 54/56 |
| 327,622 | A | * | 10/1885 | Tourgee et al. | 24/171 |
| 433,617 | A | * | 8/1890 | Cluff | 24/335 |
| 524,834 | A | * | 8/1894 | Mayent | 24/300 |
| 605,719 | A | * | 6/1898 | Janin | 24/334 |
| 781,544 | A | * | 1/1905 | McMurtry | 2/323 |
| 914,637 | A | * | 3/1909 | Coe | 24/298 |
| 987,326 | A | * | 3/1911 | Savage | 24/174 |
| 1,195,874 | A | | 8/1916 | Thurston | |
| 1,352,799 | A | * | 9/1920 | Erdley | 24/302 |
| 1,358,560 | A | * | 11/1920 | Kennison | 24/507 |
| 1,489,159 | A | * | 4/1924 | Schilling | 24/485 |
| 1,782,057 | A | | 11/1930 | Bollinger | |
| 1,784,717 | A | * | 12/1930 | Barnes | 24/485 |
| 1,962,730 | A | * | 6/1934 | Boyd | 24/300 |
| 2,114,561 | A | * | 4/1938 | Hausmann | 2/309 |
| 2,525,985 | A | * | 10/1950 | Weymouth | 24/511 |
| 2,569,371 | A | * | 9/1951 | Cohen | 24/511 |
| 2,727,247 | A | * | 12/1955 | Bailey | 2/323 |
| 2,782,482 | A | * | 2/1957 | Baril et al. | 24/501 |
| 2,988,314 | A | | 6/1961 | Urich | |
| 3,058,183 | A | * | 10/1962 | Hawie | 24/328 |
| 3,087,214 | A | * | 4/1963 | Puterbaugh | 24/300 |
| 3,170,213 | A | * | 2/1965 | Thomas, Jr. | 24/571 |
| 3,418,698 | A | | 12/1968 | Holcomb | |
| 3,657,774 | A | * | 4/1972 | Reynolds | 24/298 |
| 3,727,272 | A | * | 4/1973 | Rhodes | 24/300 |
| 3,774,267 | A | | 11/1973 | Sneider | |
| 4,158,906 | A | * | 6/1979 | Watson | 24/306 |
| 4,277,864 | A | * | 7/1981 | Orson, Sr. | 24/327 |
| 4,596,569 | A | * | 6/1986 | Campbell | 604/387 |
| 4,937,886 | A | * | 7/1990 | Ellis | 2/323 |
| 4,962,571 | A | * | 10/1990 | Visser | 24/301 |
| D322,390 | S | * | 12/1991 | Nimtz et al. | D8/395 |
| 5,077,868 | A | * | 1/1992 | Visser | 24/301 |
| 5,121,526 | A | * | 6/1992 | Burkard et al. | 24/336 |
| 5,148,560 | A | * | 9/1992 | Torres | 5/496 |
| 5,179,743 | A | * | 1/1993 | Lanman | 5/498 |
| 5,473,796 | A | * | 12/1995 | Fusillo | 24/30.5 R |
| 5,551,128 | A | | 9/1996 | Townsend | |
| 5,655,270 | A | | 8/1997 | Boisvert | |
| 5,687,458 | A | | 11/1997 | Coker | |
| 6,038,748 | A | | 3/2000 | Durney | |
| 6,161,235 | A | | 12/2000 | Smith | |
| 6,185,766 | B1 | | 2/2001 | Farrugia | |
| 6,266,854 | B1 | | 7/2001 | Ancona | |

(Continued)

*Primary Examiner* — Robert J Sandy
*Assistant Examiner* — Abigail E Morrell
(74) *Attorney, Agent, or Firm* — Grace J. Fishel

(57) ABSTRACT

A laundry retainer for bed sheets to prevent entanglement with smaller items in a mixed load. The retainer has a base plate on which at least four clothes clips are mounted. The clothes clips grip the side edges of a sheet to form a generally closed mouth bag in which smaller items in a mixed load are less likely to become entangled.

8 Claims, 4 Drawing Sheets

U.S. PATENT DOCUMENTS

| | | | | |
|---|---|---|---|---|
| 6,438,805 | B1 * | 8/2002 | Goss et al. | 24/302 |
| 7,222,631 | B2 * | 5/2007 | Silva | 132/277 |
| 7,225,507 | B2 | 6/2007 | Anderson | |
| 7,228,646 | B1 | 6/2007 | Purcell | |
| 7,275,868 | B2 | 10/2007 | Miller | |
| 7,506,415 | B2 | 3/2009 | Brian | |
| 2002/0062522 | A1 | 5/2002 | Deckert | |
| 2010/0064544 | A1 * | 3/2010 | Luong et al. | 34/239 |

* cited by examiner

LAUNDRY RETAINER FOR BED SHEETS

BACKGROUND OF THE INVENTION

1. Field of the Invention

The present invention relates to a laundry retainer disposed to receive and retain a bed sheet while it is washed in a washing machine or dried in an automatic dryer in a manner that other clothes in a mixed load do not become entangled.

2. Brief Description of the Prior Art

With mixed loads of laundry including a bed sheet with socks, underwear, towels, and the like, it is common for the smaller items to become entangled in the bed sheet forming a twisted lump. This interferes with washing and, in particular, with drying. While the problem occurs with flat sheets, it is especially a problem with fitted sheets and it is unrealistic to sort laundry such that sheets are laundered separately.

In a dryer, the clothes entangled in the sheet are usually still wet at the end of the cycle. The lump must be untangled and the dryer restarted to finish drying the load. This is a waste of energy and time. Additionally, the clothes which were partially dried in a tangled and twisted state may be more wrinkled than if they had been free to fluff and tumble from the beginning.

There are many laundry aids for keeping pairs of socks together or for bunching items of an individual in a mixed load but the problem with sheets has not been addressed.

BRIEF SUMMARY OF THE INVENTION

In view of the above, it is an object of the present invention to provide a laundry retainer that keeps smaller items in a mixed load of laundry from becoming entangled in a bed sheet and forming a lump. It is another object to provide a laundry retainer that saves energy and time by keeping clothes from entangling in a bed sheet. It is also an object to provide a laundry retainer that keeps clothes in a mixed load including sheets free to fluff and tumble. Other objects and features of the invention will be in part apparent and in part pointed out hereinafter.

In accordance with the invention, a laundry retainer for bed sheets includes a base plate and at least four clothes clips. When the base plate is plus shaped with lobe shaped arms, the clothes clips are attached to the lobes. The clothes clips have a first end for gripping and retaining a side edge of a sheet and a second end for attaching the clip to the base plate. When the clips are pivotally attached to the base plate, the clips can pivot between a plane parallel to the base plate and planes normal to the base plate.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
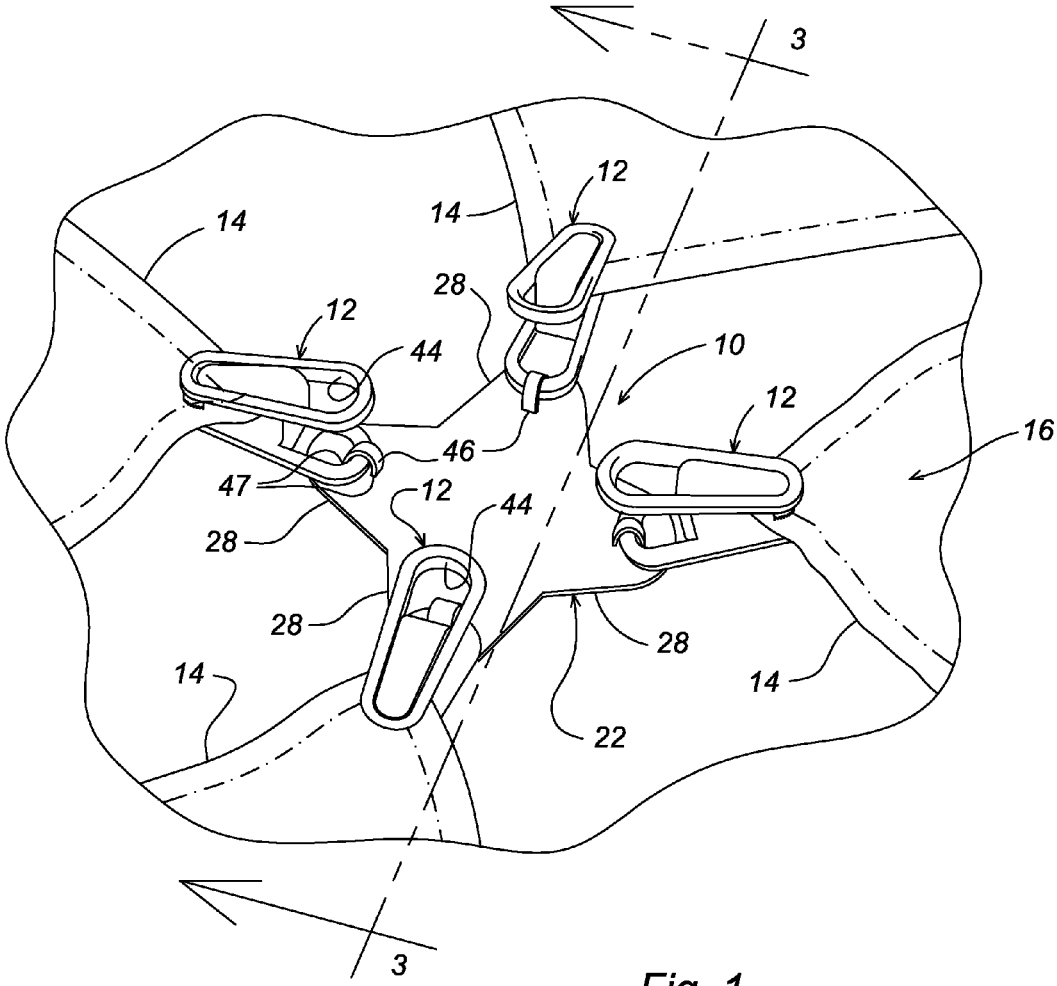
FIG. 1 is a perspective view of a laundry retainer in accordance with the present invention attached to four side edges of bed sheet to form a closed mouth bag with four clothes clips pivotally attached to a base plate in a plane substantially parallel with the base plate and facing outwardly.
Figure 2:
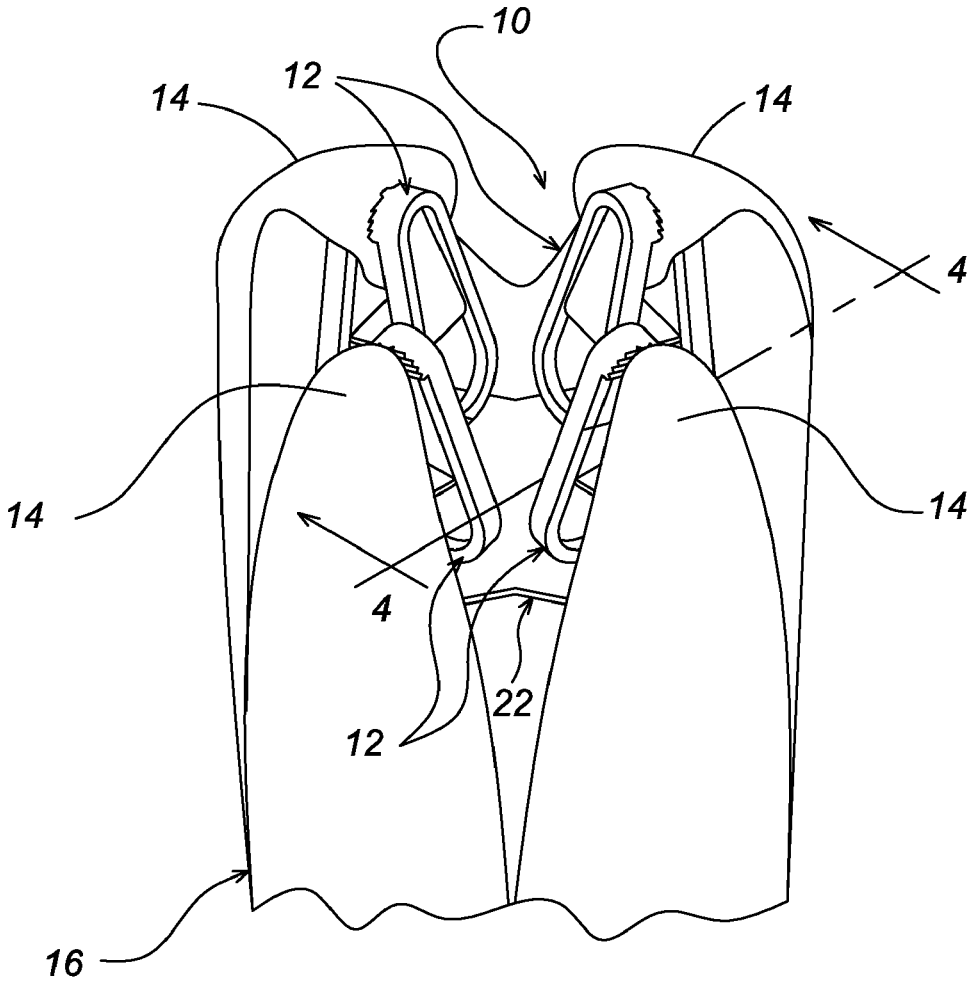
FIG. 2 is a perspective view of the laundry retainer attached to four side edges of a bed sheet with the four clothes clips pivoted in planes substantially normal to the base plate to narrow the opening of the closed mouth bag.

Referring to the drawings more particularly by reference character, reference numeral 10 refers to a laundry retainer in accordance with the present invention. As best seen in FIGS. 1 and 2, retainer has at least four clips 12 for attachment to the side edges 14 of a flat or fitted bed sheet 16 for use in drawing the side edges together to form a generally closed mouth bag in which smaller items in a mixed load of laundry are less likely to become entangled.

Figure 3:
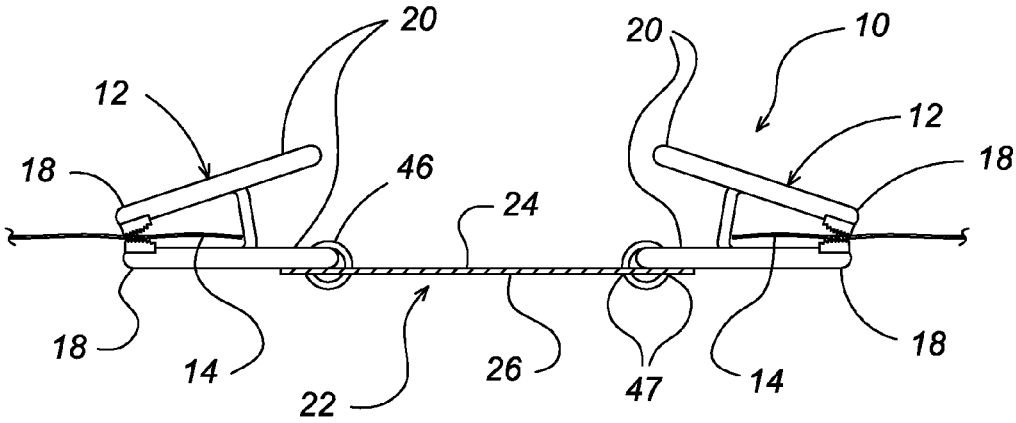
FIG. 3 is a cross section taken along the plane of 3-3 in FIG. 1.
Figure 4:
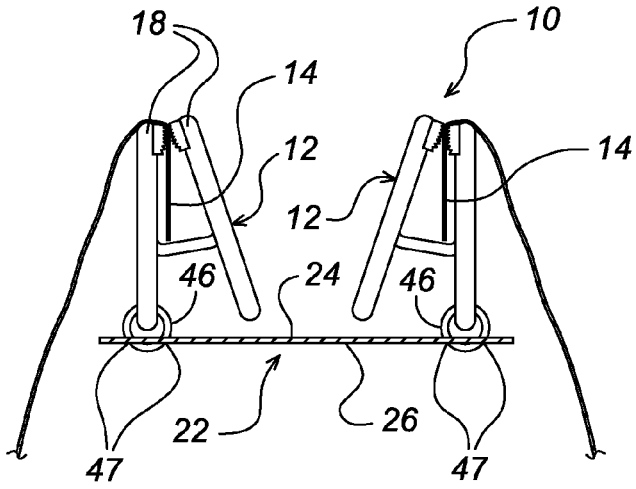
FIG. 4 is a cross section taken along the plane of 4-4 in FIG. 2.

Clips 12 have a first end 18 capable of gripping and retaining side edge 14 and a second end 20 through which the clip is attached to a base plate 22. Base plate 22 has a top 24 and a bottom 26 (FIGS. 3 and 4) and preferably is rounded such that it does not catch on the laundry. As shown in FIG. 1, base plate 22 has a plus sign shape with lobe shaped arms 28. Clips 12 are mounted on lobes 28 with first end 18 facing outwardly. As illustrated, clips 12 may be pivotally attached to base plate 22 such that clips 12 move between a plane substantially parallel to top 24 of base plate 22 as shown in FIG. 1 to planes substantially normal to top 24 of base plate 22 as shown in FIG. 2 to narrow the opening of closed mouth bag.

Clips 12 and base plate 22 are preferably formed of plastic because it does not rust or stain. Suitable resilient plastic materials have deterioration resistance to washing soaps and drying temperatures. Suitable materials include high impact polystyrene or the like but clips 12 and base plate 22 may be made of other materials, for example, metal.

Figure 5:
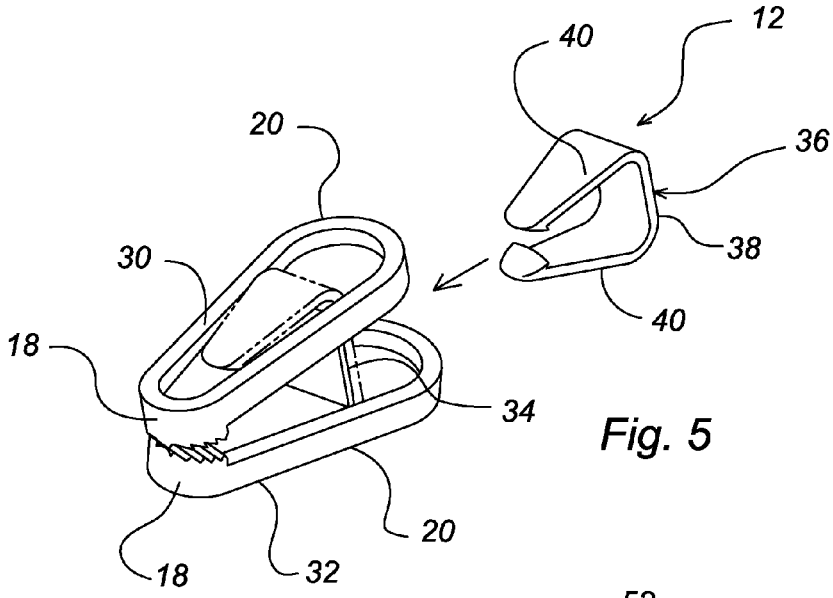
FIG. 5 is a perspective view on an enlarged scale of a clothes clip as shown in FIGS. 1-4.

Illustrative clip 12 which is best seen in FIG. 5 includes a pair of jaws 30, 32 connected with a web 34 which functions as a fulcrum intermediate first and second ends. First end 18 of jaws 30, 32 is urged into gripping contact with a resilient U-shaped member 36. With continuing reference to FIG. 5, U-shaped member 36 includes a bight 38 connected to converging arms 40. When web 34 is seated on bight 38, converging arms 40 urge jaws 30, 32 into gripping contact with side edge 14 of sheet 16. Second end 20 of each clip 12 includes an aperture 44 (FIG. 1) for use in pivotally attaching clip 12 to base plate 22 with a ring 46 or the like. For which purpose, base plate 22 includes a pair of apertures 47 through which ring 46 passes.

Figure 6:
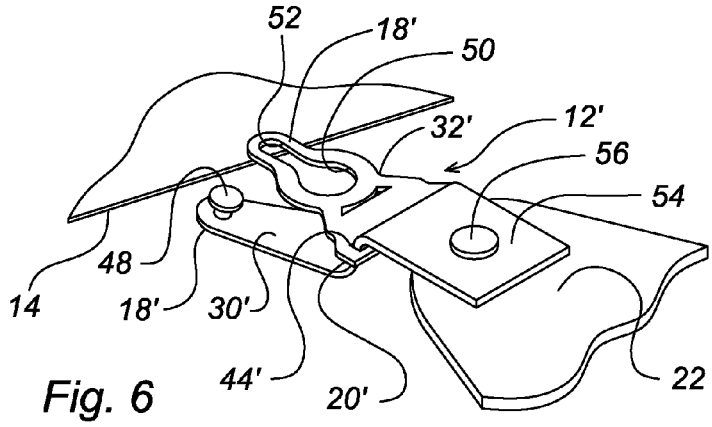
FIG. 6 is a perspective view of a second clothes clip for use in the present invention; and, FIG. 7 is side elevation of a third clothes clip for use in the present invention.
Figure 7:
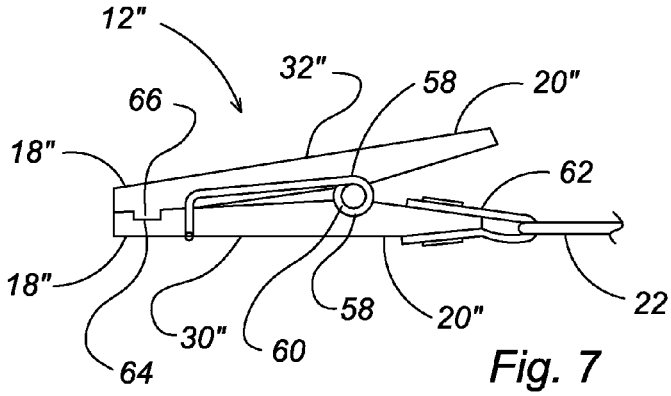

Other clips may also be utilized, examples of which are shown in FIGS. 6 and 7. Referring first to FIG. 6 a garter clip 12' is illustrated. Garter clip 12' includes a post 48 at first end 18' of first jaw 30'. First jaw 30' is formed of a flexible member such as a strip of canvas, plastic or the like. First end 18' of second jaw 32' includes a key-hole aperture with a larger opening 50 through which post 48 may be passed and a smaller opening 52 into which post 48 may be locked and held by compression. Larger opening 50 is sized so as to accept post 48 along with a portion of a sheet side edge 14. Once post 48 and a portion of the sheet are positioned within larger opening 50, they may be slid into smaller opening 52 where they are securely held. Advantageously, as sheet 16 is pulled against the clamping action of garter clip 12', smaller opening 52 operates to increase its locking hold on the sheet that is positioned within it by post 48. Aperture 44' is provided in second end 20' of second jaw 32' through which a strap 54 is passed by means of which clip 12' may be pivotally attached to base plate 22. As illustrated garter strap 54 is doubled over and attached to base plate 22 with a rivet 56 or the like.

A third clip 12" is shown in FIG. 7. The inner faces of jaws 30", 32" have transversely extending grooves 58 which are arcuate in cross section and form seats to receive a coil spring 60 which extends transversely between the jaws and about which the jaws are adapted to rock. The ends of coil spring 60 are formed to provide arms which extend longitudinally with one arm fitting close against the side edge face of jaw 30" while the other arm extends along the opposite side face of jaw 32". Arms are bent to extend towards the outer faces of the two jaws and are then bent to form fingers received in grooves extending across the outer faces of jaws 30", 32" adjacent their first ends 18". By pressing on second ends 20" jaws 30", 32" may be rocked about springs 60 which act as fulcrums. One of jaws 30", 32" carries a loop 62 which passes through an aperture provided in base plate 22 for pivotally attaching clip 12" to base plate 22. For improved gripping, first end 18" of first jaw 30" has a transversely extending groove 64 which is adapted to receive a rib 66 on second jaw 32" together with a portion of side edge 14 of sheet 16.

In use before or after sheet 16 is washed, retainer 10 is used to join side edges 14 of sheet 16 together to form a closed mouth bag. As retainer 10 tumbles in a washing machine or dryer, clips 12 (12', 12" and so forth) pivot normal to the plane of base plate 22 further closing the neck of the bag. With sheet 16 formed into a closed mouth bag, smaller items of wash are not entangled in sheet 16. A mixed load of wash is thus more effectively washed and efficiently dried and may come out of a dryer less wrinkled.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A laundry retainer for bed sheets to prevent entanglement with smaller items in a mixed load of laundry in a washer or dryer comprising a resilient base plate with a top and a bottom and a side edge, at least four clothes clips substantially equally spaced about the periphery of the base plate, said clips having a first end capable of gripping and retaining a side edge of a sheet and a second end whereby the clip is attached to the base plate with the first end facing outwardly, each of the clips pivotally attached to the base plate and having limited movement between a plane substantially parallel to the top of the base plate with the first end facing outwardly and a plane substantially normal thereto with the first end facing upwardly when the bed sheet is tumbled in the washer or dryer, whereby when said laundry retainer is attached to the four side edges of the bed sheet, the laundry retainer draws the side edges together to form a generally closed mouth bag in which smaller items in a mixed load are less likely to become entangled.

2. The laundry retainer of claim 1 wherein the second end of each clip has an aperture and the base plate has a pair of apertures, said retainer further comprising a ring for pivotally attaching the clip to the base plate, said ring passing though the aperture in the clip and apertures in the base plate.

3. The laundry retainer of claim 1 wherein the base plate has a plus sign configuration with four lobes to which the four clips are attached.

4. The laundry retainer of claim 1 wherein the base plate and clips are formed of plastic with deterioration resistance to washing soaps and drying temperatures.

5. A laundry retainer for bed sheets to prevent entanglement with smaller items in a mixed load of laundry in a washer or dryer comprising a resilient base plate with a top and a bottom and a side edge, at least four clothes clips substantially equally spaced about the periphery of the base plate, said clips having first and second jaws, each of said first and second jaws having a first end capable of gripping and retaining a side edge of a sheet and a second end whereby each clip is pivotally attached to the base plate and has limited movement between a plane substantially parallel to the top of the base plate with the first end facing outwardly and a plane substantially normal thereto with the first end facing upwardly when the bed sheet is tumbled in the washer or dryer, said first and second jaws of each clip connected by a web that functions as a fulcrum intermediate the first and second ends, each of said clips further including a U-shaped member with a bight connected to converging arms, said converging arms urging the first end of the first and second jaws into gripping contact when the web connecting the first and second jaws is seated on the bight of the U-shaped member whereby when said laundry retainer is attached to the four side edges of the bed sheet, the laundry retainer draws the side edges together to form a generally closed mouth bag in which smaller items in a mixed load are less likely to become entangled.

6. The laundry retainer of claim 5 wherein the second end of each clip has an aperture and the base plate has a pair of apertures, said retainer further comprising a ring for pivotally attaching the clip to the base plate, said ring passing though the aperture in the clip and apertures in the base plate.

7. The laundry retainer of claim 5 wherein the base plate has a plus sign configuration with four lobes to which the four clips are attached.

8. The laundry retainer of claim 5 wherein the base plate and clips are formed of plastic with deterioration resistance to washing soaps and drying temperatures.

* * * * *